US006130526A

United States Patent [19]

Yang et al.

[11] Patent Number: 6,130,526

[45] Date of Patent: Oct. 10, 2000

[54] VOLTAGE REGULATOR WITH WIDE CONTROL BANDWIDTH

[75] Inventors: Eric X. Yang, Saratoga; Lajos Burgyan, Palo Alto; Prabhjyot S. Bhurji, Sunnyvale, all of Calif.

[73] Assignee: Semtech Corporation, Newbury Park, Calif.

[21] Appl. No.: 09/285,505

[22] Filed: Apr. 2, 1999

[51] Int. Cl.[7] ..... G05F 1/56

[52] U.S. Cl. ..... 323/272; 323/284

[58] Field of Search ..... 323/282, 284, 323/268, 272

[56] References Cited

U.S. PATENT DOCUMENTS

| | | | |
|---|---|---|---|
| 4,766,364 | 8/1988 | Biamonte et al. | 323/272 |
| 4,816,739 | 3/1989 | Sakurai et al. | 323/272 |
| 5,001,620 | 3/1991 | Smith | 323/272 |
| 5,793,191 | 8/1998 | Elmore et al. | 323/272 |

*Primary Examiner*—Shawn Riley
*Attorney, Agent, or Firm*—D'Alessandro & Ritchie

[57] ABSTRACT

A fast buffer and switching regulator are combined in parallel in a master-slave loop topology to form a voltage regulator. The buffer circuit has a voltage sensing amplifier that senses the difference between the voltage at the output of the voltage regulator and a reference voltage. This voltage difference is amplified, and then input to a buffer that sources current to or sinks current from the output of the voltage regulator. The output of the buffer circuit is coupled to the switching converter which senses the changing buffer circuit output current. The switching converter changes its duty cycle to oppose the current from the buffer circuit. This is a master-slave loop topology wherein the buffer circuit is the master loop that quickly provides high levels of current to compensate for a voltage transient at the output of the voltage regulator, and the switching converter is the slave loop which eventually takes over from the master loop to meet the current output requirements of the voltage regulator.

5 Claims, 3 Drawing Sheets

VOLTAGE REGULATOR WITH WIDE CONTROL BANDWIDTH

BACKGROUND OF THE INVENTION

1. Field of the Invention

The present invention relates to voltage regulators. More particularly, the present invention relates to voltage regulator that employs a switching circuit having a pulse width modulator controlled by a high speed buffer circuit employed in a master-slave topology for fast response to rapidly changing load current.

2. The Prior Art

As the number of transistors employed in an integrated circuit increases, particularly for example in a microprocessor, the requirements for supplying power to the integrated circuit have become more demanding. It is presently contemplated that as the Vcc in a microprocessor drops to approximately 1 to 1.5 volts, the current required by the microprocessor will be in a range of about 35 to about 50 amps. Accordingly, the power dissipation in the microprocessor will be at least 50 watts.

To conserve power in a multitude of applications, such as a notebook computer, the microprocessor will switch into a sleep mode, as is presently understood by those of ordinary skill in the art. When the microprocessor is switched from sleep mode to a waking mode, current must be provided very quickly. For a microprocessor operating a 1 GHz it is anticipated that 50 amps of current must be provided at a slew rate of approximately 1 amp/nanosecond at the power pins of the microprocessor. A further requirement is that the supply voltage of the microprocessor should be kept within a tolerance band of that does not exceed approximately 2–3%. Traditional linear and conventional switched regulators well known to those of ordinary skill in the art are respectively too inefficient in meeting these requirements or too slow to meet these requirements.

In a typical linear power supply or voltage regulator circuit, a linear control element, such as a pass transistor, in series with an unregulated DC is used, with feedback, to maintain a constant output voltage. The output voltage is always lower in voltage than the unregulated input voltage, and some power is dissipated in the control element. Though the linear power supply has a fast response time, it is not very efficient. As such, it is it is not a realistic approach to proving power in many integrated circuit applications.

In a switching converter, a transistor is typically operated as a saturated switch that periodically applies the full unregulated voltage across an inductor for short intervals. The current in the inductor builds up during each pulse, storing ½ $LI^2$ of energy in its magnetic field. The stored energy is transferred to a filter capacitor at the output that also smooths the output by carrying the output load between the charging pulses. In order to accommodate rapid and transient load changes, and to filter the switch frequency from the output, the output capacitor preferably has a large value with a very low equivalent series resistance (ESR). With feedback, the output of the converter is compared with an input preset reference to control the switching frequency or pulse width of the signal applied to the transistor operated as a switch. Since the control element is either off or on, the power dissipation in the regulator is minimized. Accordingly, switching regulators are very efficient, even when there is a large voltage drop from the input to the output. However, there is limitation on how quickly a switching converter can provide current to readily changing load condition.

In FIG. 1, a known DC-DC converter 10, referred to by those of ordinary skill in the art as a step-down or "buck" topology, is illustrated. In converter 10, the switching speed of a MOSFET transistor 12 is controlled by the output a comparator 14 fed through a driver 16 and coupled to the gate of MOSFET transistor 12. The comparator 14 has an inverting input connected to a signal that in this example oscillates between 0 and 2 volts, and a non-inverting input connected to a feedback loop to form a pulse width modulator (PWM). The drain of MOSFET transistor 12 is connected to Vin, and the source of MOSFET transistor 12 is connected a first terminal of inductor 18 and the anode of Schotky diode 20. In this example the inductor has a value of 10 uH. The second terminal of inductor 18 is connected to a first plate of load capacitor 20. A second plate of load capacitor 20 is connected to the cathode of Schotky diode 18 and to a ground reference potential to complete a loop for current circulation. The common connection of the second terminal of inductor 18 and the first plate of capacitor 20 forms the output node Vout of the switching converter 10.

The output node Vout is also coupled to a first end of first impedance block 24 in a feedback loop. A second end of impedance block 24 is coupled to the inverting input of error amplifier 26. A second impedance block 28 provides feedback to error amplifier 26 in a manner well understood by those of ordinary skill in the art. The non-inverting input of error amplifier 26 is connected to a reference potential Vref. The output of error amplifier 24 is connected to the inverting input of comparator 14 to complete the feed back loop to the MOSFET transistor 12.

In the switching converter 10, a higher input voltage at Vin is converted to a lower input voltage at Vout. When the MOSFET transistor 12 is turned on by the output of comparator 14, the voltage Vin−Vout is applied across the inductor 18, causing a linearly increasing current to flow through the inductor 18. When the MOSFET transistor 12 is turned off by the output of comparator 14, inductor current continues to flow in the same direction with the Schotky diode 22 conducting to complete the circuit. Since the voltage across the inductor 18 is now the sum of Vout and the nominal voltage of the Schotky diode 22, the inductor current will decrease linearly. The load capacitor 20 operates to minimize current and voltage ripple at the output of the switching converter 10. It will be appreciated that as the size of the capacitor 20 increases, the amount of ripple decreases, however, the response time of the converter 10 to changes in the load also increases.

As the load at Vout changes, the feedback loop including the error amplifier 26 forms a control circuit to ensure that Vout remains at a desired value with a high degree of precision. In the feedback loop, Vout is compared to Vref. The difference between Vref and Vout determines the width of the pulse from comparator 14 driving the MOSFET transistor 12 to control the amount of energy delivered to a load in a manner well understood by those of ordinary skill in the art.

A schematic model 30 of capacitor 20 including the ESR 32 and the ESL 34 is illustrated in FIG. 2. The minimum impedance of capacitor 20 is achieved for the frequency, $F_o$, at which the ESR is minimized. This frequency is found according to the following well known relation.

$$F_0 = \frac{1}{2\pi\sqrt{ESLAC}}$$

For a well rated capacitor 20, this will provide a frequency of approximately 1 MHz. It will be appreciated by those of ordinary skill in the art that the impedance of the capacitor 20 should be made as small as possible so that the rate of current being supplied to the load will be adequate before the current in the inductor 18 can be built up. With a 10 uH inductor having a voltage drop of 5 volts to 2 volts across its terminals, current will be provided at a rate of about only 3 mA/nS. Accordingly, other solutions for providing current to the load at an acceptable rate have been sought.

In one approach disclosed in European patent application EP 0 699 986 A2 to Danstrom, a switching regulator is disposed in series with a linear regulator. The switching regulator forms a front-end to control the input voltage of the linear regulator to prevent power loss in the linear regulator. This approach is not that efficient because current continuously flows through the linear regulator.

In another approach disclosed in U.S. Pat. No. 5,258,701 to Pizzi et al., a switching regulator is disposed in parallel with a linear regulator. Both the switching regulator and the linear regulator are independently controlled. The reference voltage of the switching regulator is set at a higher voltage level than that of the linear regulator. Unless the transient load results in the output voltage falling below that of the reference voltage of the linear regulator, the linear regulator is in a shut-off mode.

In a further approach disclosed in the data sheet for part nos. HIP6200 and HIP6201 manufactured by Harris Semiconductor published February 1998, an independently controlled buffer circuit is disposed in parallel with a switching regulator. There is a preset tolerance band for the output voltage. When the output voltage goes out of this tolerance band, the buffer circuit responds with a preset current source or current sink. The manner of control is provided through hysterisis by sensing the output voltage.

In both the Pizzi et al. and Harris Semiconductor approaches, there is lack of a control mechanism to force the switch regulator current to equal the load current. This requires that the switching regulator have a tight voltage band tolerance. This can be a problem because it requires matching two independently set reference voltages. Further, in microprocessor application, tight voltage band tolerance may not be feasible because for some static regulation errors bigger transient voltage spikes are permitted.

Accordingly, it is an object of the present invention to provide a voltage regulator having a switching regulator in combination with a linear regulator that does not exhibit the drawbacks found in prior art approaches.

BRIEF DESCRIPTION OF THE INVENTION

According to the present invention, a fast light-duty regulator and a slow heavy-duty regulator are combined in parallel in a master-slave loop topology to form a voltage regulator. A buffer circuit implementing the fast light-duty regulator has a voltage sensing amplifier that senses the difference between the voltage at the output of the voltage regulator and a reference voltage, due to, for example, a load transient. This voltage difference is amplified, and then input to the buffer circuit to source current to or sink current from the output of the voltage regulator. The output of the buffer circuit is coupled to a switching converter implementing the slow heavy-duty regulator which senses the changing buffer circuit output current. The switching converter changes its duty cycle to oppose the current from the buffer circuit. After the load transient has passed, the switching converter provides all of the load current, and the buffer circuit drops its output current to zero. This is a master-slave loop topology wherein the buffer circuit is the master loop that quickly provides high levels of current to compensate for the voltage drop, and the switching converter is the slave loop which eventually takes over from the master loop to meet the current output requirements of the voltage regulator. The master-slave topology responds to rapidly changing load current conditions in a very fast and efficient manner.

DETAILED DESCRIPTION OF A PREFERRED EMBODIMENT

Those of ordinary skill in the art will realize that the following description of the present invention is illustrative only and not in any way limiting. Other embodiments of the invention will readily suggest themselves to such skilled persons.

Figure 1:
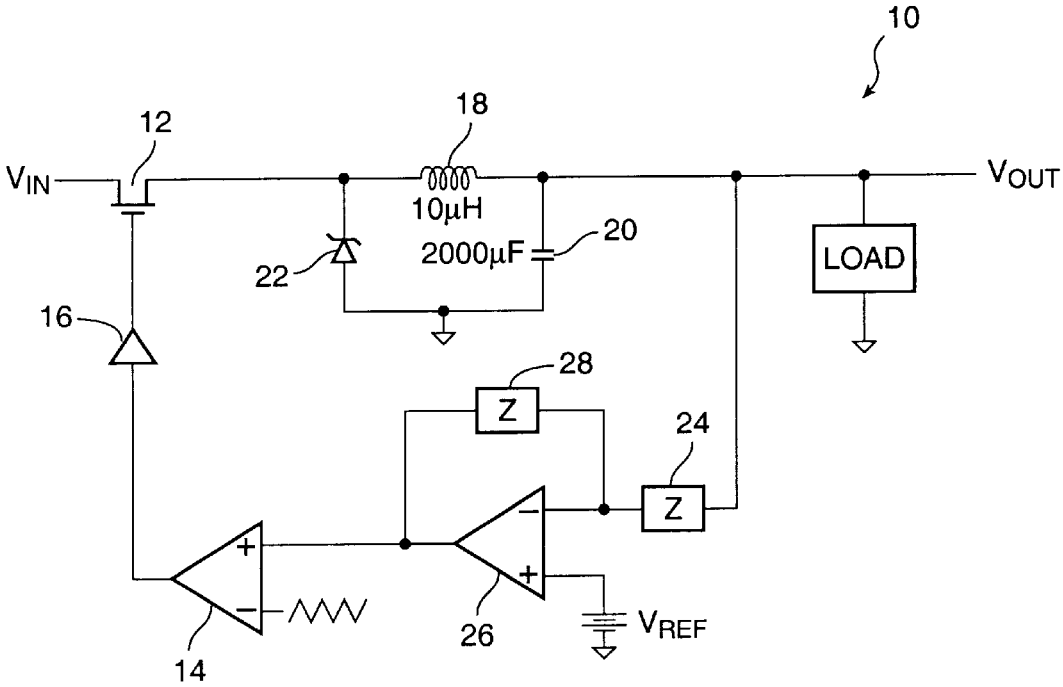
FIG. 1 (PRIOR ART)
FIG. 1 is a schematic diagram of a switching converter suitable for use according to the present invention.
Figure 2:
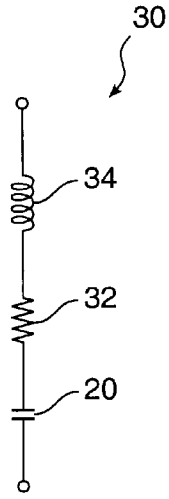
FIG. 2 is a schematic diagram of a capacitor illustrating the equivalent series resistance and inductance in a capacitor.
Figure 3:
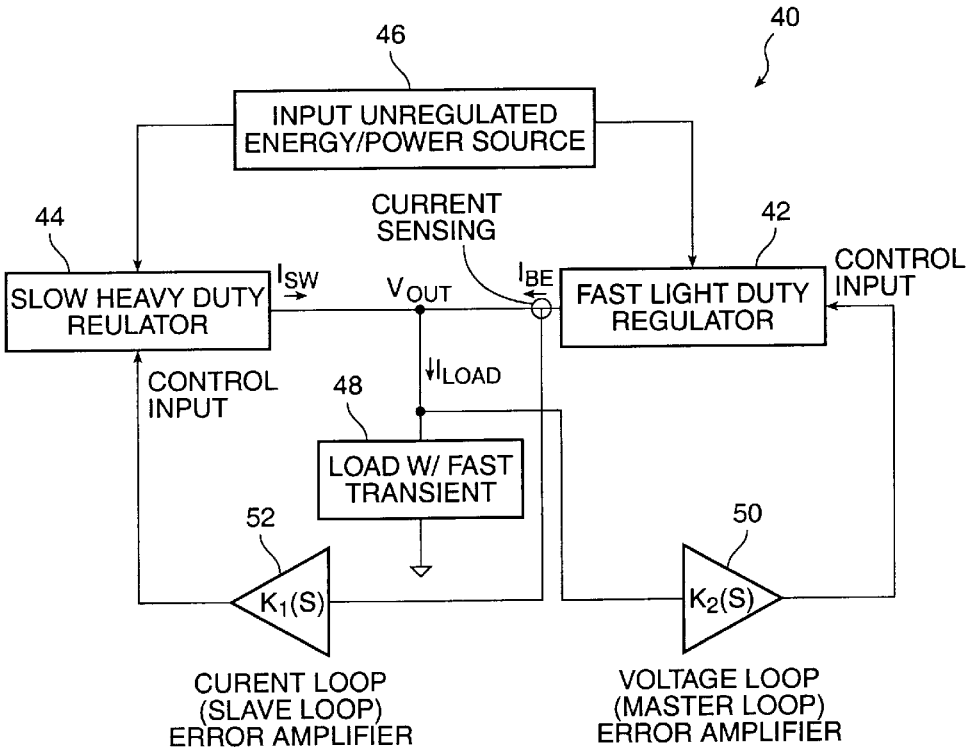
FIG. 3 is a block diagram of the voltage regulator according to the present invention.

In FIG. 3, a block diagram of the voltage regulator 40 according to the present invention is illustrated. In the voltage regulator 40, a fast light duty regulator 42 and a slow heavy duty regulator 44 are coupled in a master-slave topology. The unregulated input 46 to the voltage regulator 40 is coupled to both the light duty regulator 42 and the heavy duty regulator 44. The output, Vout, of the voltage regulator 40 is coupled to the load 48 and also to the outputs of both the light duty regulator 42 and the heavy duty regulator 44. The master loop includes an error amplifier 50 having an input coupled to Vout, and an output coupled to a control input of the light duty regulator 42. The slave loop includes an error amplifier 52 having an input coupled to the output of the light duty regulator 42, and an output coupled to a control input of the heavy duty regulator 44.

In the operation of the voltage regulator 40, the fast light duty regulator 42 and heavy duty regulator 44 are combined in parallel in a master-slave loop topology to form a voltage regulator 40 that responds to rapidly changing load current conditions in a very fast and efficient manner. In this master-slave loop topology, the master loop, which includes the fast light duty regulator 42, senses a voltage drop at the output of the voltage regulator 40 due to a load transient, and very quickly provides high levels of current to compensate for the voltage drop. In the slave loop, the heavy duty regulator 44 senses the change in the output current of the master loop, and works to minimize or oppose this change in current. When the load transient has passed, heavy duty regulator 44 provides all of the load current, and the light duty regulator 42 drops its output current to zero.

Figure 4:
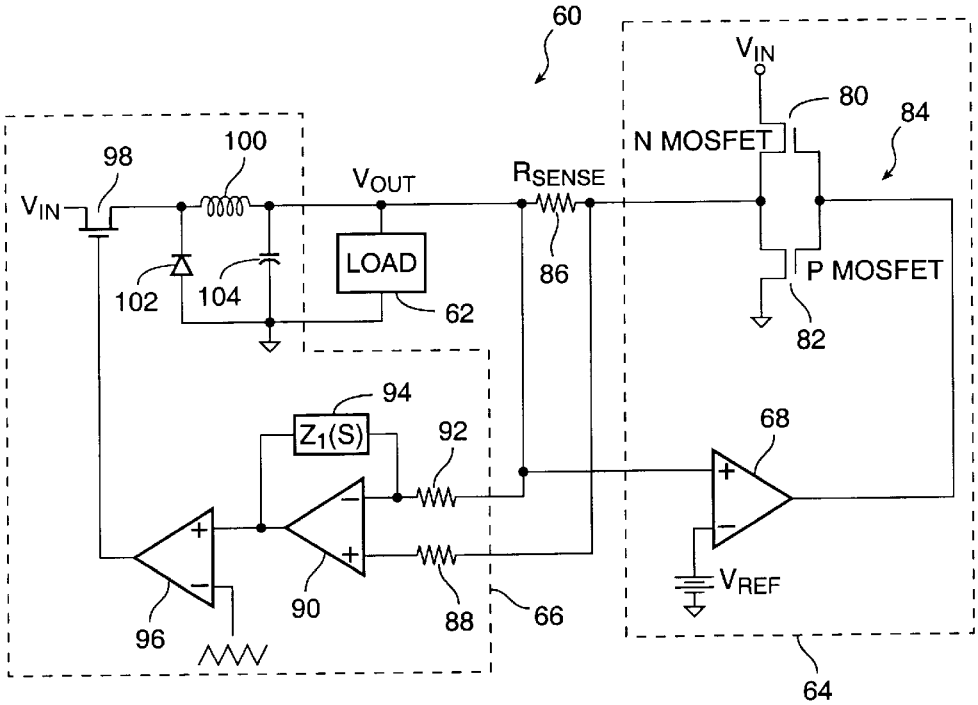
FIG. 4 is a schematic diagram of the voltage regulator according to the present invention.

Turning now to FIG. 4, a schematic diagram of a preferred embodiment of the voltage regulator 60 according to the present invention is illustrated. In voltage regulator 60, a load 62 is connected to the output of both a buffer circuit implementing the fast light-duty regulator shown within the dashed lines indicated by reference numeral 64 representing a master loop, and a switching converter implementing the slow heavy-duty shown within the dashed lines indicated by reference numeral 66 representing a slave loop.

In the buffer circuit 64, a voltage reference, Vref, is coupled to the non-inverting input of a voltage sensing error amplifier 60, and output voltage, Vout, of the voltage regulator 60 is coupled to the inverting input of voltage sensing error amplifier 68. The implementation and biasing of voltage sensing error amplifier 68 is well within the level of skill of those of ordinary skill in the art and will not be disclosed herein to avoid obscuring the present invention.

The output of voltage sensing error amplifier 68 is coupled to the gates of the N-channel MOS transistor 80 and P-channel MOS transistor 82. The N-channel MOS transistor 80 and P-channel MOS transistor 82 form an inverter 84 to source and sink current to the load 62. The drain of N-channel MOS transistor 80 is coupled to the unregulated voltage input, Vin, and the drain of P-channel MOS transistor 82 is coupled to ground. The source of N-channel MOS transistor 80 is connected to the source of P-channel MOS transistor 82 to form the output of buffer circuit 64. It should be appreciated by those of ordinary skill in the art that the source/sink implemented by inverter 84 may alternatively be implemented as an bipolar transistor emitter follower or as a combined bipolar and MOSFET circuit.

The output of buffer circuit 64 is connected to a first end of a resistor 86 and also through a resistor 88 to the non-inverting input of current sensing error amplifier 90 in the switching converter 66. A second end of resistor 86 is connected to Vout and also to the inverting input of current sensing error amplifier 90 through a resistor 92. An impedance 94 is coupled between the output and the inverting input of current sensing error amplifier 90 to provide compensation in a manner well known to those of ordinary skill in the art The output of current sensing error amplifier 90 is coupled to the non-inverting input of a comparator 96. The inverting input of comparator 96 is connected to an oscillating signal which according to the present invention oscillates between 0 and 2 V. The output of comparator 96 is connected to the gate of an N-channel MOS transistor 98 implemented as a switch. The drain of N-channel MOS transistor 98 is coupled to Vin, and the source of N-channel MOS transistor 98 is coupled to a first end of an inductor 100 and the cathode of a diode 102. The second end of inductor 100 is coupled to a first plate of a capacitor 104. The common node of the second end of inductor 100 and the first plate of capacitor 104 forms Vout. The second plate of capacitor 104 is coupled to the anode of diode 102, and also to a reference voltage, preferably ground. According to the preferred embodiment of the present invention, the inductor 100 has a value of 2 $\mu$H, and the value of the capacitor 104 has a value of 200 $\mu$F. It should also be appreciated that according to this embodiment of the present invention, that the inductor 100 and capacitor 104 both have an equivalent series resistance of approximately 20 Mohms and 1 Mohms, respectively.

According to present invention, the operation of the voltage regulator 60 may be observed by first considering the operation of the buffer circuit 64 forming the master loop, and then considering the operation of the switching converter 66 forming the slave loop. In buffer circuit 64, Vout is compared with Vref by voltage sensing error amplifier 68 to sense the voltage difference between Vout and Vref. The voltage difference is fed into inverter 84 to either source or sink current at its output in response to the amplified voltage difference. The amount of current is related to the size of the voltage transient at Vout. The master loop works quickly to either source or sink current as needed in response to the transient.

The change in the current output of the buffer circuit 64 is sensed by current sensing error amplifier 90. In response, the switching converter 66 changes the duty cycle of the N-channel MOS transistor 98 to oppose the change in the output current of buffer circuit 64. Accordingly, although the buffer circuit 64 provides an immediate current response, the switching converter 66 rapidly fulfills the current requirement output of the voltage regulator 60. One particular advantage of the present invention is that the efficiency of the voltage regulator may be close to or even better than the efficiency of a switching converter by itself, because the high switching frequency required to boost the control bandwidth is unnecessary in the present invention.

Figure 5A:
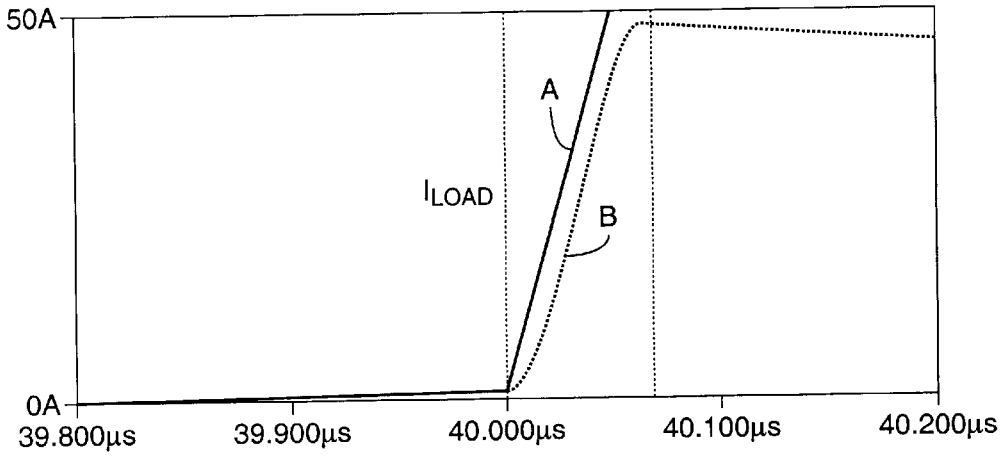
FIG. 5A graphically illustrates changes in the output current of a buffer circuit in the voltage regulator of FIG. 4 in response to a changing load condition according to the present invention.
Figure 5B:
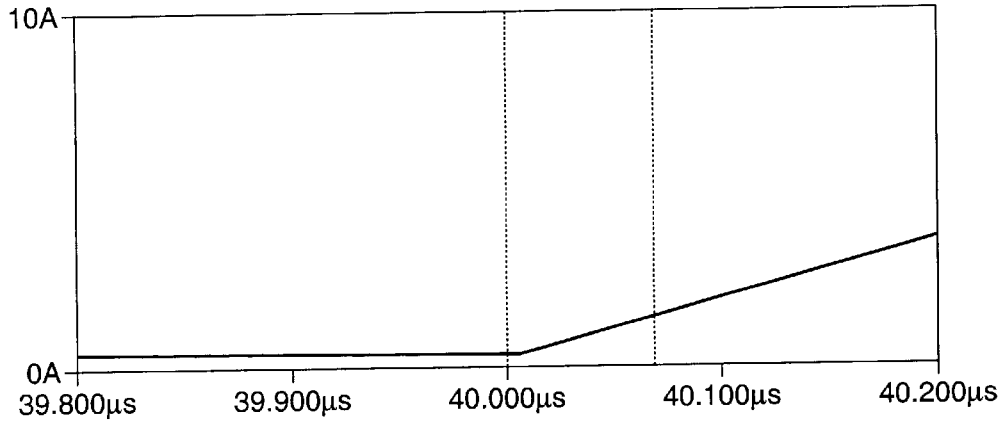
FIG. 5B graphically illustrates changes in the output current of a switching converter in the voltage regulator of FIG. 4 in response to a changing load condition according to the present invention.
Figure 5C:
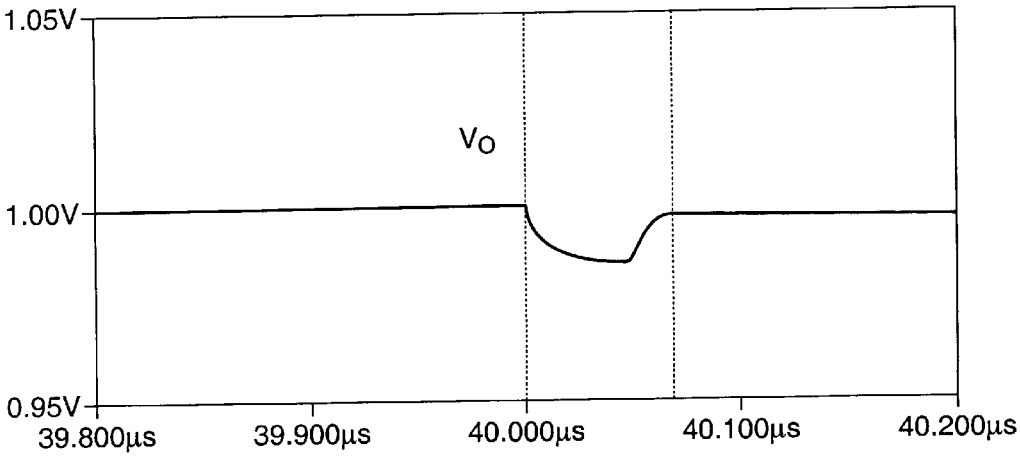
FIG. 5C graphically illustrates changes in the voltage at the output of the voltage regulator of FIG. 4 in response to a changing load condition according to the present invention.

In FIGS. 5A–5C, the response of the voltage regulator 50 to changing load conditions can be observed. In FIG. 5A, the load current requirements change abruptly to 50 amps as shown in trace A, and the output current from the buffer circuit 64 nearly matches the load current requirements as shown in trace B with only a very short delay. Almost immediately after supplying the required load current, the current output from the buffer circuit 64 begins to drop. In FIG. 5B, it can be seen that simultaneously the current output from the switching converter 66 begins to ramp up so that within approximately two microseconds (not shown), the current provided by the switching converter 66 has ramped from 0 to 50 amps. During this time frame, the current output of the buffer circuit 64 goes in the reverse direction from 50 amps to 0 amps. In FIG. 5C, it can be observed that in response to the increased current requirements, that a transient voltage spike of only approximately 15 mV to 17 mV occurs.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A voltage regulator having an input and an output comprising:

a buffer circuit having an input coupled to the input of the voltage regulator, a voltage sensing input coupled to the output of the voltage regulator to sense an electrical transient at the output of the voltage regulator, and an output providing current in a fast response to said electrical transient; and a switching converter having an input coupled to said input of the voltage regulator, a current sensing input coupled to said output of said buffer circuit to sense a current at said output of said buffer circuit, and an output coupled to the output of the voltage regulator that provides current in a slow response to said electrical transient.

2. A voltage regulator having an input and an output comprising:

a voltage sensing amplifier having an input coupled to the output of the voltage regulator to sense an electrical transient at the output of the voltage regulator, and an output;

a fast light-duty regulator having a first input coupled to the output of said voltage sensing amplifier, a second input coupled to an unregulated voltage source at the input of the voltage regulator, and an output providing current of a first duration in a fast response to said electrical transient and said second input coupled to a reference voltage;

a current sensing amplifier having an input coupled to the output of said fast light-duty regulator to sense said current provided at said output of said fast light-duty regulator, and an output; and a slow heavy-duty regulator having a first input coupled to said output of said voltage sensing amplifier, a second input coupled to said unregulated voltage source at the input of the voltage regulator, and an output providing current of a second duration in a slow response to said electrical transient.

3. A voltage regulator having an input and an output comprising:

a master-loop having an input and an output including:

a voltage sensing amplifier having an inverting input, a noninverting input, and an output, said inverting input forming said input of said master-loop and coupled to the output of said voltage sensing amplifier, and said noninverting input coupled to a reference potential; and an inverter having a p-channel MOS transistor and an N-channel MOS transistor, a gate of said p-channel transistor and a gate of said n-channel transistor coupled to said output of said voltage sensing amplifier, a drain of said n-channel transistor coupled to the input of said voltage regulator, a drain of said p-channel MOS transistor coupled to a ground potential, and a source of said n-channel MOS transistor and a source of said p-channel MOS transistor coupled together to form the output of said master loop; and a slave-loop having an input and an output including:

a current sensing amplifier having an inverting input, a noninverting input, and an output, said inverting input and said noninverting input forming said input of said slave-loop, said inverting input coupled through a resistor to said output of master-loop output, and said noninverting input coupled to said output of said master-loop;

a comparator having an inverting input, a noninverting input, and an output, said inverting input coupled to an oscillating signal, and said noninverting input coupled to said output of current sensing amplifier; and a switching converter having a transistor, an inductor, a capacitor, and a diode, a gate of said transistor coupled to said output of said comparator, a drain coupled to the input of the voltage regulator, and a source of said transistor coupled to a first end of said inductor and a cathode of said diode, a second end of said inductor coupled to a first plate of said capacitor and the output of the voltage regulator, a second plate of said capacitor and an anode of said diode coupled to aground potential.

4. A voltage regulator having an input and an output comprising:

a master-loop having input coupled to the output of said voltage regulator, an output, and a fast regulator to provide current in response to an electrical transient at the output of the voltage regulator; and a slave-loop having an input connected to said output of said master loop, an output connected to the output of the salve-loop, and a slow regulator to provide current in response to said electrical transient at the output of the voltage regulator.

5. A voltage regulator as in claim 4, wherein the slave-loop in providing a slow response to a voltage transient at the output of the voltage regulator first opposes the fast response to the said electrical transient by said master loop.

* * * * *